US011944195B2

(12) United States Patent
Buschermöhle et al.

(10) Patent No.: US 11,944,195 B2
(45) Date of Patent: Apr. 2, 2024

(54) DRAWER INSERT

(71) Applicant: KESSEBÖHMER HOLDING KG, Bad Essen (DE)

(72) Inventors: Hermann Buschermöhle, Bersenbrück (DE); Daniel Haarmann, Hagen a. T. W. (DE); Mathias Lücke, Bramsche (DE)

(73) Assignee: KESSEBÖHMER HOLDING KG, Bad Essen (DE)

( * ) Notice: Subject to any disclaimer, the term of this patent is extended or adjusted under 35 U.S.C. 154(b) by 282 days.

(21) Appl. No.: 17/442,135

(22) PCT Filed: Mar. 31, 2020

(86) PCT No.: PCT/EP2020/059110
§ 371 (c)(1),
(2) Date: Apr. 25, 2022

(87) PCT Pub. No.: WO2020/216585
PCT Pub. Date: Oct. 29, 2020

(65) Prior Publication Data

US 2022/0248846 A1 Aug. 11, 2022

(30) Foreign Application Priority Data

Apr. 25, 2019 (DE) ..... 20 2019 102 341.4

(51) Int. Cl.
*A47B 88/994* (2017.01)
*A47B 88/975* (2017.01)

(52) U.S. Cl.
CPC ..... *A47B 88/994* (2017.01); *A47B 88/975* (2017.01)

(58) Field of Classification Search
CPC ... A47B 88/969; A47B 88/994; A47B 88/975; A47B 88/976; A47B 88/977; A47B 88/981; B42F 15/0094
See application file for complete search history.

(56) References Cited

U.S. PATENT DOCUMENTS 2,214,042 A * 9/1940 Burdick ..... A47B 88/90 220/543
3,067,903 A * 12/1962 Jones, Jr. ..... A47B 88/90 402/503

(Continued)

FOREIGN PATENT DOCUMENTS

CN 202234006 U 5/2012
CN 102811645 A 12/2012

(Continued)

OTHER PUBLICATIONS

International Search Report for patent application PCT/EP2020/059110 dated May 12, 2020 and issued by the European Patent Office, translation provided.

(Continued)

*Primary Examiner* — Patrick D Hawn
(74) *Attorney, Agent, or Firm* — Hassan Abbas Shakir; Shakir Law PLLC

(57) ABSTRACT

A drawer insert has a frame structure. The frame structure includes several corner parts and several elongated side parts, and several elastic dividing elements, where are fastened displaceably on the frame structure. The corner parts and the side parts of the frame structure are joined to one another in non-destructively and reversibly detachable manner.

15 Claims, 7 Drawing Sheets

(56) References Cited

U.S. PATENT DOCUMENTS 3,356,228 A * 12/1967 Woodhouse ..... B42F 15/0094 211/184
3,860,119 A * 1/1975 Irvine ..... B42F 15/0094 211/175
4,030,610 A 6/1977 Alexander
4,049,127 A * 9/1977 Alexander ..... B42F 15/0094 211/184
4,091,933 A * 5/1978 Alexander ..... B42F 15/0094 403/172
4,176,753 A * 12/1979 Godfrey ..... B42F 15/0094 403/172
4,262,810 A * 4/1981 Llich ..... B42F 15/0094 211/206
4,475,657 A * 10/1984 Albery ..... B42F 15/0094 403/217
4,526,277 A * 7/1985 Snowden ..... B42F 15/0094 312/184
5,042,769 A * 8/1991 Smed ..... F16B 7/044 248/231.81
5,205,626 A * 4/1993 Fotioo ..... B42F 15/0094 403/403
5,255,798 A * 10/1993 Aaldenberg ..... A47B 45/00 312/184
5,339,969 A * 8/1994 Filipowski ..... A47B 63/00 211/189
5,358,126 A * 10/1994 Jones ..... B42F 15/0094 211/189
5,405,020 A * 4/1995 Fotioo ..... B42F 15/0094 211/189
5,515,980 A * 5/1996 Fotioo ..... B42F 15/0094 211/189
5,553,710 A * 9/1996 Takama ..... B65D 25/06 206/561
5,570,792 A * 11/1996 Huang ..... B42F 15/0094 211/189
5,607,215 A * 3/1997 Pacetti ..... A47B 88/975 312/348.3
5,628,405 A * 5/1997 Price ..... A47F 7/024 220/571
5,651,596 A * 7/1997 Carlson ..... A47B 88/994 312/334.32
5,721,531 A * 2/1998 Garver ..... B42F 15/0094 340/8.1
5,996,749 A 12/1999 Hillsberg
6,073,794 A 6/2000 Bidot
6,390,359 B1 * 5/2002 Lin ..... A47B 88/90 220/692
6,493,917 B1 * 12/2002 Sunka ..... A47B 88/994 312/348.3
6,834,924 B2 * 12/2004 Hollenstein ..... A47B 88/994 312/348.3
7,163,118 B2 * 1/2007 Cheng ..... A47B 88/994 206/561
7,380,894 B2 * 6/2008 Berger ..... A47B 88/994 312/348.3
9,380,915 B2 * 7/2016 Sabounjian ..... A47J 31/44
10,716,399 B2 * 7/2020 Brown ..... A47B 88/90
10,874,213 B2 * 12/2020 Lawson ..... A47B 88/975
11,503,910 B1 * 11/2022 Carmen ..... A47B 88/975
2003/0164665 A1 * 9/2003 Guay ..... A47B 88/90 312/348.3
2003/0184199 A1 * 10/2003 Jananji ..... A47B 88/975 312/348.3
2003/0227241 A1 * 12/2003 LaBonia, Jr. ..... A47B 88/975 312/348.3
2005/0072785 A1 * 4/2005 Cheng ..... A47B 88/994 220/528
2007/0251897 A1 * 11/2007 Chang ..... B42F 15/0094 211/46
2007/0273258 A1 * 11/2007 Ernst ..... A47B 88/90 312/348.3
2008/0083753 A1 * 4/2008 Escobar ..... A47B 88/994 220/8
2008/0185387 A1 * 8/2008 Wu ..... A47B 88/969 220/510
2008/0258593 A1 * 10/2008 Berger ..... A47B 88/994 312/348.3
2008/0295976 A1 * 12/2008 Watanabe ..... A47B 88/90 211/184
2009/0045246 A1 * 2/2009 Dodson ..... B42F 15/0035 229/67.2
2010/0072154 A1 3/2010 Johnson
2012/0037520 A1 * 2/2012 Cline ..... A47B 41/00 206/214
2012/0205335 A1 * 8/2012 Abdullahi ..... A47B 88/90 211/184
2022/0287460 A1 * 9/2022 Guzeltepe ..... A47B 88/975

FOREIGN PATENT DOCUMENTS

CN 103763986 A 4/2014
CN 103857313 A 6/2014
CN 203633772 U 6/2014
CN 205704067 U 11/2016
DE 202008004309 U1 7/2008
DE 202009015649 U1 4/2011
DE 202012101948 U1 6/2012
DE 10 2016 121 138 A1 5/2018
EP 1457138 A1 9/2004
EP 2250937 A1 11/2010
EP 2818078 A1 12/2014
JP 3143118 U 7/2008

OTHER PUBLICATIONS

International Search Report for patent application PCT/EP2020/059110 uploaded toe WIPO Patentscope Oct. 29, 2020 and issued by the European Patent Office, machine translation of supplemental box provided.

Search Report of German Patent Application DE 20 2019 102 341.4 dated Jan. 27, 2020 issued by the German Patent and Trademark Office (DPMA), partial machine translation provided.

English Translation of Office Action in related Chinese Patent Application 202080028956.6 issued by the China National Intellectual Property Administration dated Jul. 18, 2022, 8 pgs.

* cited by examiner

DRAWER INSERT

BACKGROUND OF THE INVENTION

1. Field of the Invention

The invention relates to a drawer insert having a frame structure, which comprises several corner parts and several elongated side parts, and several elastic dividing elements, which are fastened displaceably on the frame structure.

Furthermore, the invention relates to an assembly kit for a drawer insert that can be assembled without tools.

Beyond that, the invention relates to a drawer unit having a drawer and a drawer insert, which is disposed in the drawer.

2. Discussion of the Related Art

Generic drawer inserts are usually used to subdivide inside regions of drawers into several subcompartments separated from one another, so that objects can be positioned in organized and/or sorted relationship inside the drawer. Moreover, the frame structure and the elastic dividing elements of the drawer insert ensure that the inserted objects cannot tip over and fall out. Beyond that, such drawer inserts provide for improved organization of the inserted objects inside the drawer and thus increase the accessibility and reachability of the objects positioned inside the drawer.

The objects to be inserted may be different articles, such as kitchen aids, pots, food products, tableware or other consumable materials. By means of appropriate drawer inserts, the different object types can be stored in several regions of the drawer, in a manner separated by dividing elements. The designated advantages of such drawer inserts lead in practice to a considerable increase of comfort, especially for the storage of household articles in drawers.

Different organizational systems for separate storage of articles are already known in the prior art. For example, publication EP 1 457 138 A1 discloses a furniture element having flexible straps, wherein the flexible straps can be fastened at predetermined positions of a side wall. Because of the predetermined position for fastening the straps, however, the scope of application of the proposed furniture element is restricted, and so the positionability of the flexible straps is not adequate for some application situations.

Publication EP 2 818 078 A1 teaches a furniture fixture, which can be used to create an organizational system in a drawer. The separating partitions of one embodiment disclosed in that document are fastened displaceably on a frame structure. However, the frame structure is constructed as a one-piece body, and so the frame structure cannot be taken apart. This has the consequence that the furniture fixture has to be packaged in a large-volume package. Corresponding large packages lead to considerable transportation and storage expense for the manufacturer and the distributors, whereby the overall costs for the end consumers are significantly increased. Furthermore, because of the one-piece frame structure, the furniture fixture disclosed in the publication cannot be inserted in drawers having only partial extension. Because of the partial extension, such drawers have a reduced access region, and so drawer inserts having rigid frame structures become tilted during insertion. The alternative comprising complete removal of such a drawer is either not feasible for the end consumer or is rejected by the end consumer because of the great effort needed.

SUMMARY OF THE INVENTION

The object of the invention consists in being able to equip drawers with an organizational insert that has freely displaceable elastic dividing elements, wherein the organizational insert is also intended to be insertable even in drawers having partial extension, without the need to remove the drawer.

The object is achieved by a drawer insert of the type mentioned in the introduction, wherein the corner parts and the side parts of the frame structure of the inventive drawer insert are joined to one another in nondestructively and reversibly detachable manner.

The invention makes use of the knowledge that, by means of a drawer insert capable of being taken apart, a compact package size as well as compatibility with partial extension drawers can be achieved. By the fact that the corner parts and the side parts of the frame structure are joined to one another in nondestructively and reversibly detachable manner, the package volume can be considerably reduced, and so transportation and storage costs for the manufacturer and the distributors of the drawer insert are considerably lowered. For example, the package can be designed as a so-called flat pack, in which the components of the drawer insert are placed in a flat and compact package, which is optimized for transportation and storage purposes. Because of the ability of the drawer insert to be taken apart, it can also be assembled inside the drawer. Thus the drawer insert can also be used directly in drawers that are provided with only partial extension and thus have restricted accessibility.

By means of the elastic dividing elements, sorting of the inserted objects is possible. The dividing elements are preferably set up to be adapted to the shape of the inserted objects. The inserted objects may be designated as stored goods and be articles of different type. For example, kitchen aids, pots, food products, tableware or other consumable materials may be inserted in the drawer insert.

The corner parts of the frame structure may also be designated as corner connectors. The side parts of the frame structure may also be designated as longitudinal connectors or as cross connectors. For example, the frame structure of the drawer insert has four corner parts, wherein the corner parts disposed next to one another are respectively joined to one another via one or more side parts. The corner parts may be made, for example, of plastic, metal or a metal alloy. The corner parts are preferably plastic injection-molded parts. The side parts may be made of plastic, metal or a metal alloy. The side parts are preferably constructed as rods or struts, especially metal rods or metal struts. Thus a drawer insert is preferred that does not have any flat side walls. Preferably the side regions of the drawer insert have several, for example two or three rods or struts disposed one above the other and/or extending substantially parallel to one another. The rods or struts are preferably disposed in such a way that objects inserted into the drawer insert cannot fall sideways out of the drawer insert.

The elastic dividing elements may be formed, for example, as elastic tapes or elastic straps. Preferably, the elastic dividing elements are taut in the assembled condition, so that a tensioning effect is derived from the elastic dividing elements. Therefore the elastic dividing elements may be formed as tensioning tapes or tensioning straps. The elastic dividing elements may also have a loop. Furthermore the elastic dividing elements may be formed at least in portions from a textile.

In a preferred embodiment of the inventive drawer insert, the frame structure is constructed without a bottom. In particular, the entire drawer insert is constructed without a bottom. Due to the bottomless construction of the frame structure or of the drawer insert, the contact surface for the inserted objects is provided by the drawer in which the drawer insert is inserted. Due to the bottomless design of the frame structure or of the drawer insert, the material costs are lowered and the manufacturing expense is significantly reduced.

In another preferred embodiment of the inventive drawer insert, the corner parts and the side parts of the frame structure are joined to one another without tools in a manner detachable from one another. The corner parts and the side parts of the frame structure are preferably plugged together. For example, the corner parts may be plugged into the side parts. For example, the side parts may also be plugged into the corner parts.

Moreover, an inventive drawer insert is preferred in which the outside dimensions of the frame structure define a necessary rack space, wherein the corner parts and the side parts of the frame structure can be joined as a frame structure within the rack space. During joining of the corner parts and the side parts of the frame structure, preferably no space outside the rack space is needed, so that assemblability of the drawer insert inside the drawer is created. Furthermore, an ability of the drawer insert to be taken apart inside the drawer is achieved in this way. This permits in particular the use of the drawer insert in combination with drawers that have only partial extension. In such drawers with partial extension, the assemblability of the drawer insert inside the drawer makes removal of the drawer unnecessary.

In another preferred embodiment of the inventive drawer insert, at least one corner part has one or more clamping regions. Preferably all corner parts respectively have one or more clamping regions. Preferably respectively one side part can be clamped and/or clipped in a clamping region. The clamping regions may have elastically deformable clamping struts or snap-in hooks. The clamping struts or snap-in hooks are elastically deformed during clamping or clipping of a side part in a clamping region. Such clamping regions permit assembly and disassembly of the frame structure without tools, whereby setup and breakdown of the drawer insert by the end user is made possible. The clamping regions may respectively have a stop face for the end side of a side part. If a corner part has several clamping regions, the stop faces of the respective clamping regions may be located in different stop planes. Depending on the clamping regions used, different widths and/or lengths of the drawer insert can therefore be achieved. For example, a clamping region or several clamping regions with a stop face may be used within a first stop plane, in order to create a drawer insert with a total width of approximately 520 mm. By using the same corner and side parts, a clamping region or several clamping regions with a stop face may be used within a second stop plane, in order to create a drawer insert with a total width of approximately 472 mm. Thus the dimensions of the drawer insert can be adapted to different drawer sizes.

In another embodiment of the inventive drawer insert, the one or more clamping regions respectively defines or define a seating and withdrawal path for a side part, wherein the seating and withdrawal path extends at right angles to the longitudinal axis of the inserted side part. For example, the seating and/or withdrawal of a side part may take place from inside, outside, above and/or below. In particular, when the seating and withdrawal path extends within the rack space defined by the frame structure, comfortable and smooth assembly and disassembly of the drawer insert is possible inside the drawer.

In a further development of the inventive drawer insert, it is advantageous that at least one corner part, preferably all corner parts has or have a corner-part base and a corner-part top, wherein the corner-part base comprises the one or more clamping regions, which can be covered with the corner-part top after clamping or clipping of the side part. The corner part is therefore of multi-piece, especially two-piece construction. By the possibility of being able to cover the one or more clamping regions, contamination of the clamping regions is prevented, especially of the seating and withdrawal path for the side parts. Moreover, a bracing and/or stabilizing effect may also be derived from the corner-part top, whereby the stability of the frame structure is increased. Moreover, the covering of the clamping regions by means of a corner-part top reduces inadvertent detachment or withdrawal of a side part, for example due to improper use of the drawer insert.

Beyond that, a drawer insert is preferred in which at least one corner part, preferably all corner parts, respectively has or have one or more seats, into which respectively one side part can be pushed. Preferably an end region at the long end of a side part can be plugged into the one or more seats. Preferably the corner parts have not only one or more clamping regions but also one or more seats, via which joining with side parts can be achieved.

In another preferred embodiment of the inventive drawer insert, the one or more seats respectively defines or define a plug-in and extraction path for a side part, wherein the plug-in and extraction path extends parallel to or flush with the longitudinal axis of the plugged-in side part. Preferably the one or more plug-in and extraction paths of a side part runs or run parallel to the one or more seating and withdrawal paths of the corner part.

Preferably the corner parts respectively have two wings, wherein a first wing extends in the longitudinal direction of the drawer insert and a second wing extends in the transverse direction of the drawer insert. Preferably the first wing and the second wing are disposed at right angles to one another. In particular, the first wing has one or more clamping regions for respectively one side part. In particular, the other wing has one or more seats for respectively one side part.

In another embodiment of the inventive drawer insert, the elastic dividing elements are joined to sliding elements, wherein the respective sliding elements are displaceable along a side part in longitudinal direction of the side part. Due to the displaceability of the sliding elements along a side part, infinitely variable positioning of the sliding elements and thus also infinitely variable positioning of the elastic dividing elements is possible. Thus the elastic dividing elements are joined via the sliding elements with the side parts of the frame structure. Preferably the sliding elements respectively comprise one or more slide recesses, through which respectively one side part extends. The slide recess and the side part extending through the slide recess have substantially the same cross section. The cross section of the slide recess is made only slightly larger than the cross section of the side part, so that a sliding movement of the sliding element along the side part is permitted.

In another preferred embodiment of the inventive drawer insert, the dividing elements can be separated nondestructively from the frame structure without disassembly of the frame structure and can be joined nondestructively with the frame structure. The elastic dividing elements and the sliding elements are able to form a keder system, in which end portions of the elastic dividing elements can be plugged respectively into a sliding element. The sliding elements may also be joined with the dividing elements via a zipper system or another nondestructively detachable connection.

In an advantageous further development of the inventive drawer insert, the sliding elements respectively have a push-in slot, into which an end portion of the elastic dividing element can be nondestructively pushed in and reversibly withdrawn. The sliding elements may be constructed, for example, as keder rails. Furthermore, the end portions of the elastic dividing element may comprise a keder that can be inserted into a keder rail. A clamping device that clamps the end portion of a pushed-in elastic dividing element may be disposed in the region of the push-in slot. Via the clamping, stabilization of the end portion of the pushed-in elastic dividing element in the push-in slot is achieved. Hereby the necessary pull-out force for withdrawal of the elastic dividing element is increased.

Moreover, an inventive drawer insert is preferred in which the dividing elements are designed to be transparent at least in portions. The transparency of the dividing elements at least in portions increases the visibility of the inserted objects for the observer. The dividing elements may be designed to be transparent or partly transparent at least in portions. If the dividing elements are made from a textile material, the fibers may be spaced apart from one other in such a way that transparency is achieved. The dividing elements may also be designed to be nontransparent, i.e. opaque, in portions or completely.

The object underlying the invention is further achieved by an assembly kit of the type mentioned in the introduction, wherein the drawer insert that can be assembled with the assembly kit is a drawer insert according to one of the embodiments described in the foregoing. As regards the advantages and modifications of the inventive assembly kit, reference is made to the advantages and modifications of the inventive drawer insert.

The object underlying the invention is further achieved by drawer unit of the type mentioned in the introduction, wherein the drawer insert of the inventive drawer unit is constructed according to one of the embodiments described in the foregoing. As regards the advantages and modifications of the inventive drawer unit, reference is made firstly to the advantages and modifications of the inventive drawer insert.

The drawer of the drawer unit may have a lateral rail system, via which the drawer can be extracted from a cabinet body and/or pushed into a cabinet body. The drawer may be coupled, for example, with a pull-out system, which permits only partial extension of the drawer. Since the drawer insert can be assembled and disassembled inside the drawer, such a drawer insert may also be put together in the drawer and taken apart in the drawer without demounting the drawer. The drawer insert can therefore be designed to be assembled inside the drawer and taken apart in the drawer.

BRIEF DESCRIPTION OF THE DRAWINGS

Preferred embodiments of the invention will be explained and described in more detail hereinafter with reference to the attached drawings, wherein.

DETAILED DESCRIPTION OF THE INVENTION

Figure 1:
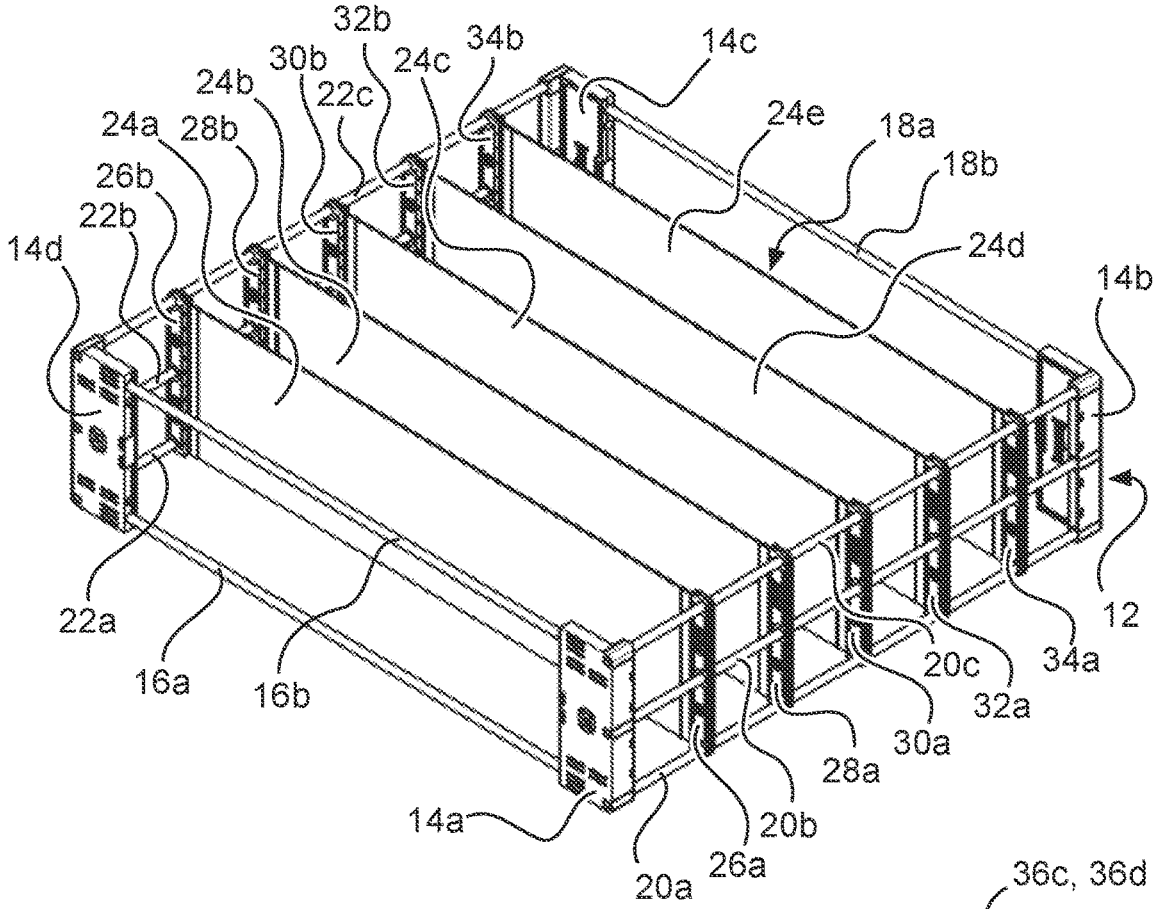
FIG. 1 shows an exemplary embodiment of the inventive drawer insert in a perspective diagram.

FIG. 1 shows a bottomless drawer insert 10. Drawer insert 10 comprises a frame structure 12, which has several corner parts 14*a*-14*d* and several elongated side parts 16*a*, 16*b*, 18*a*, 18*b*, 20*a*-20*c*, 22*a*-22*c*. The four corner parts 14*a*-14*d* in total are disposed in the four corner regions of rectangular drawer insert 10. Corner parts 14*a*-14*d* may also be designated as corner connectors, wherein corner parts 14*a*-14*d* are formed as plastic injection-molded parts. Corner parts 14*a*, 14*b* are joined to one another via side parts 20*a*-20*c*, which are formed as struts. Corner parts 14*b*, 14*c* are joined to one another via side parts 18*a*, 18*b*, which are formed as struts. Corner parts 14*c*, 14*d* are joined to one another via side parts 22*a*-22*c*, which are formed as struts. Corner parts 14*d*, 14*a* are joined to one another via side parts 16*a*, 16*b*, which are formed as struts. Side parts 16*a*, 16*b*, 18*a*, 18*b* extend parallel to one another and may also be designated as cross connectors. Side parts 20*a*-20*c*, 22*a*-22*c* likewise extend parallel to one another and may be designated as longitudinal connectors.

Frame structure 12 defines a storage space, into which objects may be inserted. Several elastic dividing elements, especially five 24*a*-24*e* in total in the present case, extend through the storage space. Via sliding elements 26*a*, 26*b*, elastic element 24*a* is fastened displaceably on frame structure 12. Via sliding elements 28*a*, 28*b*, elastic element 24*b* is fastened displaceably on frame structure 12. Via sliding elements 30*a*, 30*b*, elastic element 24*c* is fastened displaceably on frame structure 12. Via sliding elements 32*a*, 32*b*, elastic element 24*d* is fastened displaceably on frame structure 12. Via sliding elements 34*a*, 34*b*, elastic element 24*e* is fastened displaceably on frame structure 12.

Dividing elements 24*a*-24*e* are designed to be transparent in portions. In the present case, dividing elements 24*a*-24*e* are made from a textile material, wherein the fibers of the textile material are spaced apart from one other in such a way that transparency is achieved. Consequently, elastic dividing elements 24*a*-24*e* are designed to be transparent or partly transparent in portions. In other embodiments, elastic dividing elements 24*a*-24*c* may also be designed to be nontransparent, i.e. opaque.

Corner parts 14*a*-14*d* and side parts 16*a*, 16*b*, 18*a*, 18*b*, 20*a*-20*c*, 22*a*-22*c* of frame structure 12 are joined to one another in nondestructively and reversibly detachable manner. Corner parts 14*a*-14*d* and side parts 16*a*, 16*b*, 18*a*, 18*b*, 20*a*-20*c*, 22*a*-22*c* are plugged one into the other, so that assembly and disassembly of frame structure 12 can be carried out without tools.

Figure 2:
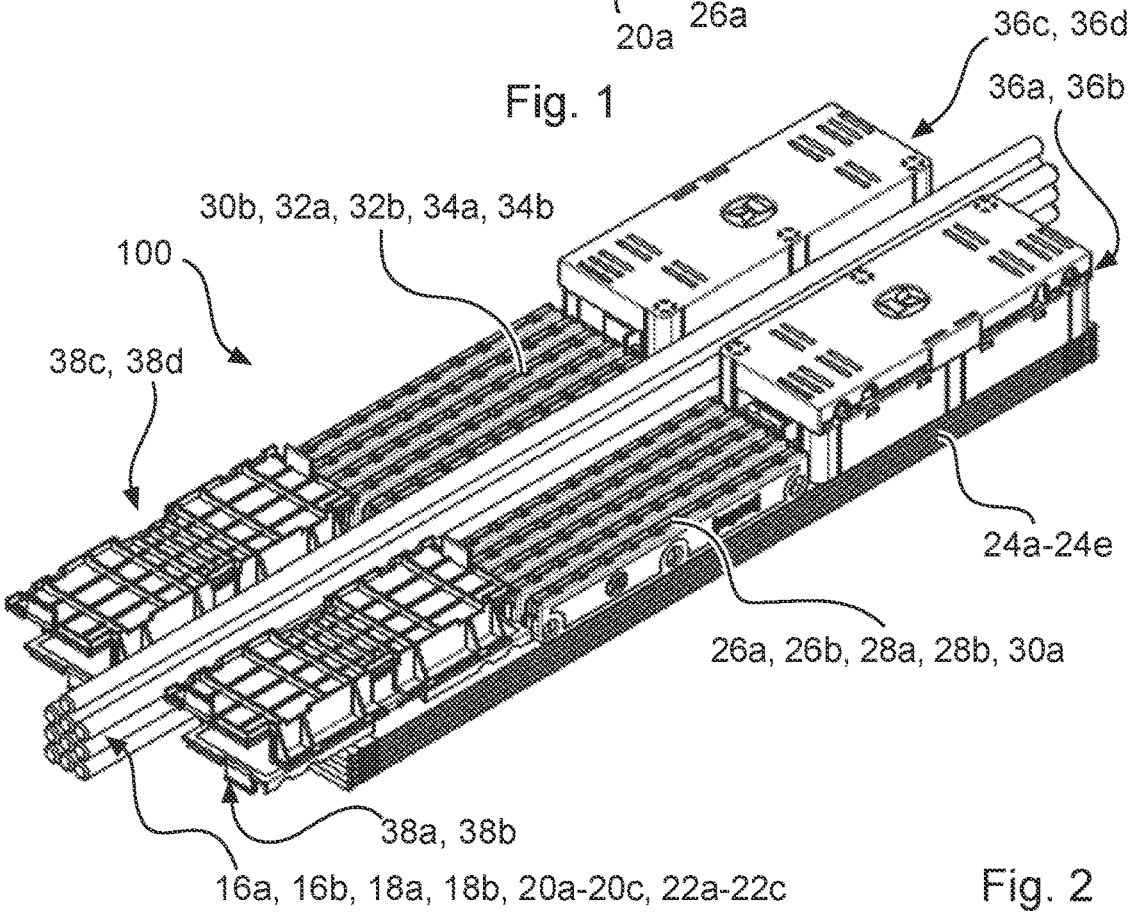
FIG. 2 shows an exemplary embodiment of the inventive assembly kit in a perspective diagram.

Due to the ability of drawer insert 10 to be taken apart, it is possible to provide assembly kit 100, which is illustrated in FIG. 2 and by means of which drawer insert 10 illustrated in FIG. 1 can be assembled without tools. By virtue of the ability of drawer insert 10 to be taken apart, assembly kit 100 has extremely compact dimensions, and so assembly kit 100 may be packaged in space-saving condition. In this way, transportation and storage costs can be considerably lowered. Due to the ability of drawer insert 10 to be assembled and disassembled without tools, it may be put together by the user himself or herself.

Corner parts 14*a*-14*d* of the illustrated assembly kit 100 respectively comprise a corner-part base 36*a*-36*d* and a corner-part top 38*a*-38*d*, wherein a corner-part top 38*a*-38*d* can be clamped or clipped in each corner-part base 36*a*-36*d*. Thus corner parts 14*a*-14*d* of assembly kit 100 are respectively of two-piece construction.

Figure 3:
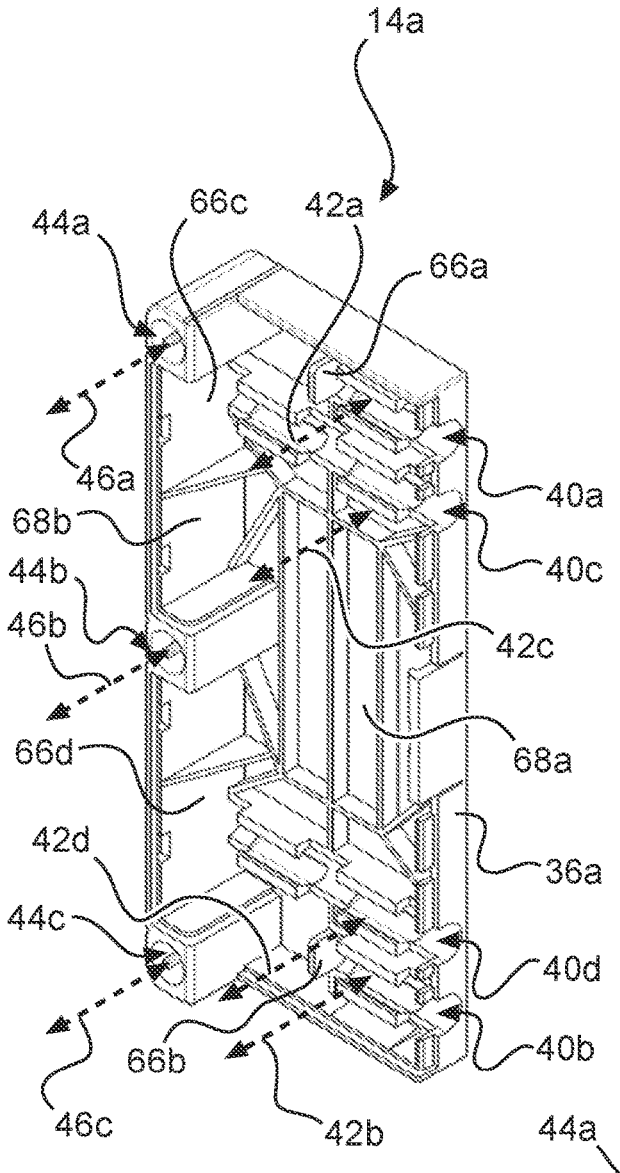
FIG. 3 shows a corner part of an inventive drawer insert without corner-part top in a perspective diagram.

FIG. 3 shows a corner-part base 36*a* of a corner part 14*a*. Corner-part base 36*a* has several, especially four clamping regions 40*a*-40*d* spaced apart from one another, into which respectively one side part 16*a*, 16*b* constructed as a strut can be clamped. Clamping struts, between which a side part 16*a*, 16*b* can be clamped, are disposed spaced apart from one another inside clamping regions 40*a*-40*d*. The clamping struts become elastically deformed during insertion and removal of a side part 16*a*, 16*b*. Stop faces 66*a*-66*d*, which define the maximum seating length of the respective clamping regions 40*a*-40*d*, are disposed inside the clamping regions. Stop faces 66*a*, 66*b* of the outer clamping regions 40*a*, 40*b* are situated in a common first stop plane. Stop faces 66*c*, 66*d* of the inner clamping regions 40*c*, 40*d* are situated in a second common stop plane. The first and second stop planes extend parallel to one another and are spaced apart from one another.

Clamping regions 40*a*-40*d* respectively define a seating and withdrawal path 42*a*-42*d* for a side part 16*a*, 16*b*. Seating and withdrawal paths 42*a*-42*d* extent at right angles to the longitudinal axis of inserted side parts 16*a*, 16*b*. In the present case, seating and withdrawal of side parts 16*a*, 16*b* take place from inside.

Furthermore, corner-part base 36*a* of corner part 14*a* has several, especially three seats 44*a*-44*c* spaced apart from one another, into which respectively one side part 20*a*-20*c* can be pushed. Seats 44*a*-44*c* respectively define a plug-in and extraction path 46*a*-46*c* for a side part 20*a*-20*c*, wherein plug-in and extraction path 46*a*-46*c* extends parallel to or flush with the longitudinal axis of plugged-in side parts 20*a*-20*c*. Seating and withdrawal paths 42*a*-42*d* and plug-in and extraction paths 46*a*-46*c* extend parallel to one another.

Corner-part base 36*a* has two wings 68*a*, 68*b*, wherein wing 68*a* extends in transverse direction of assembled drawer insert 10. Wing 68*b* extends in longitudinal direction of assembled drawer insert 10. Wing 68*a* and wing 68*b* are disposed at right angles to one another. Wing 68*a* has clamping regions 40*a*-40*d* for side parts 16*a*, 16*b*. Wing 68*b* has seats 44*a*-44*c* for side parts 20*a*-20*c*.

Figure 4:
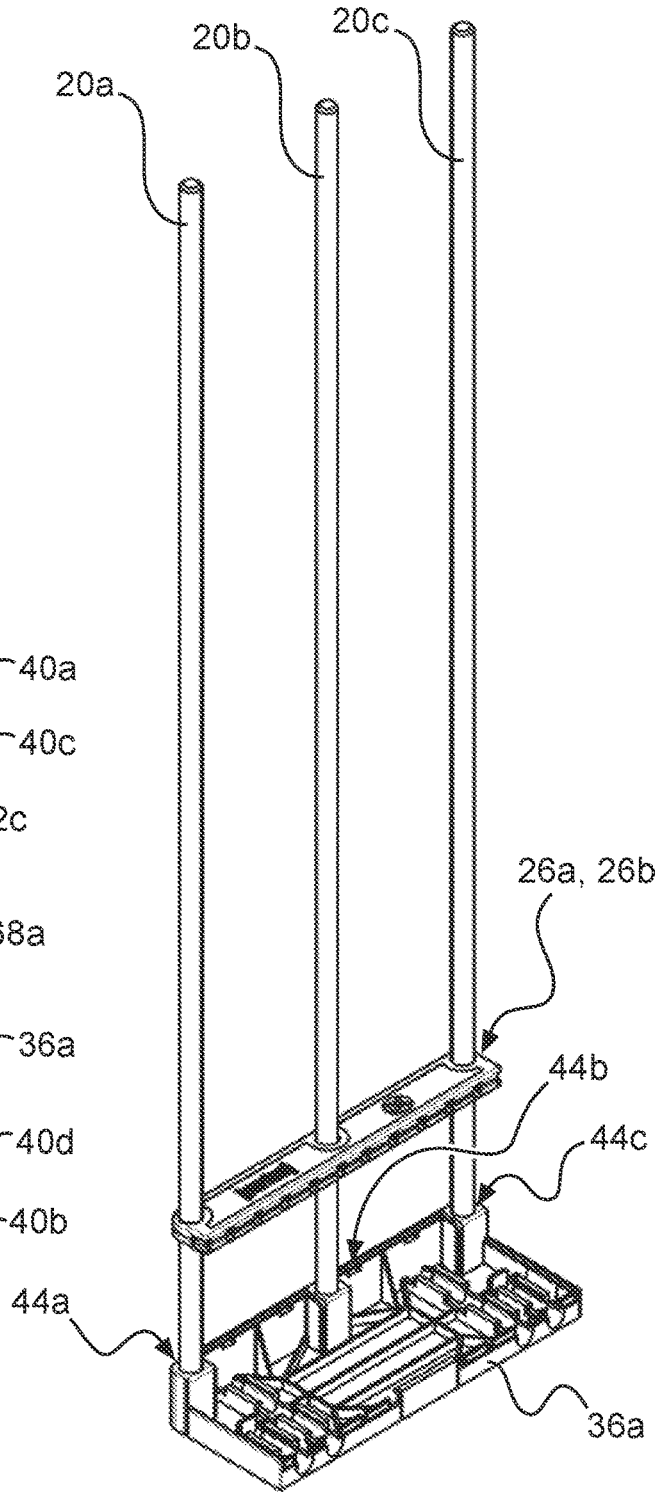
FIG. 4 shows parts of an inventive drawer insert in an assembled condition in a perspective diagram.

FIG. 4 shows a corner-part base 36*a*, in seats 44*a*-44*c* of which side parts 20*a*-20*c* constructed as struts are inserted. Two sliding elements 26*a*, 26*b* have already been pushed onto inserted side parts 20*a*-20*c*.

Figure 5:
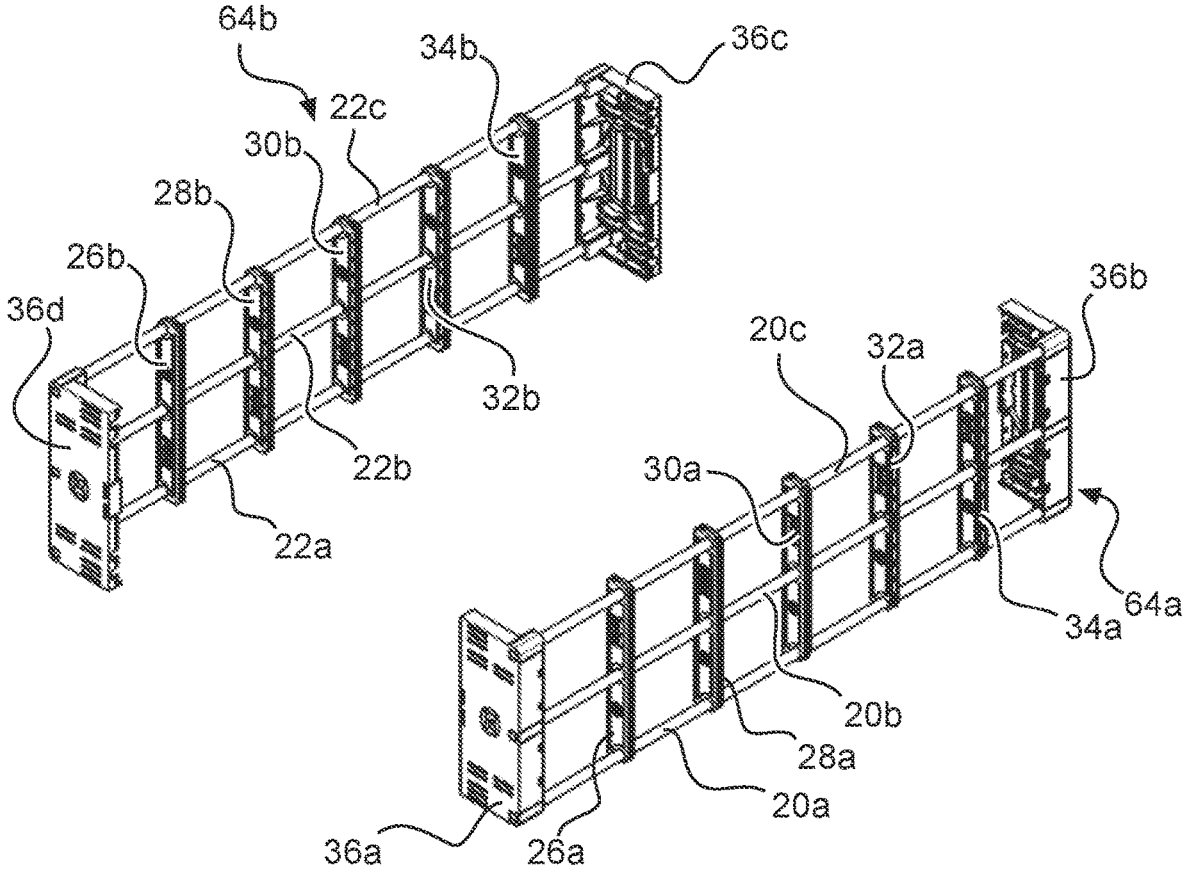
FIG. 5 shows parts of an inventive drawer insert in a further assembled condition in a perspective diagram.

In the assembled condition of drawer insert 10 illustrated in FIG. 5, two longitudinal units 64*a*, 64*b* have already been preassembled. Longitudinal unit 64*a* comprises corner-part bases 36*a*, 36*b* of corner parts 14*a*, 14*b*, side parts 20*a*-20*c* and sliding elements 26*a*, 28*a*, 30*a*, 32*a*, 34*a*. Longitudinal unit 64*b* comprises corner-part bases 36*c*, 36*d* of corner parts 14*c*, 14*d*, side parts 22*a*-22*c* and sliding elements 26*b*, 28*b*, 30*b*, 32*b*, 34*b*.

Figure 6:
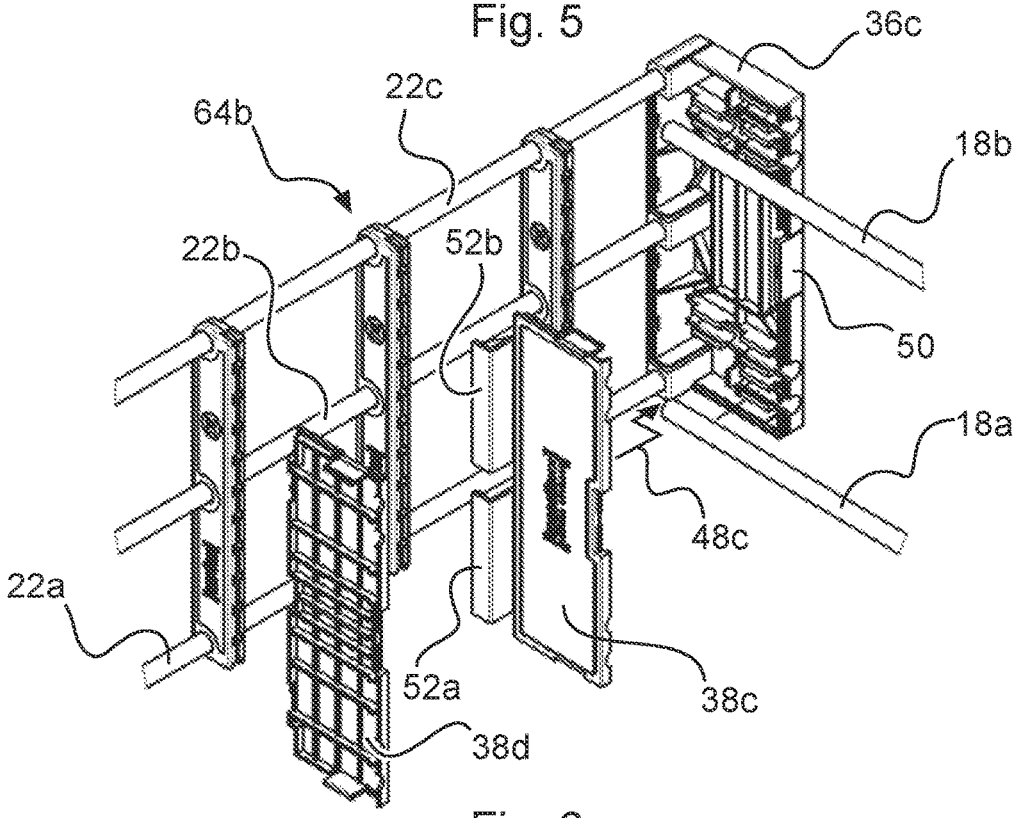
FIG. 6 shows parts of an inventive drawer insert in a further assembled condition in a perspective diagram.

FIG. 6 shows that longitudinal units 64*a*, 64*b* are joined with one another via side parts 18*a*, 18*b* during assembly of drawer insert 10. Side parts 18*a*, 18*b* are pressed into the clamping regions of corner-part bases 36*b*, 36*c*. After insertion of side parts 18*a*, 18*b*, open corner-part base 36*c* is closed with corner-part top 38*c*. For this purpose, corner-part top 38*c* is to be moved along movement path 48*c*. The fixation of corner-part top 38*c* on corner part base 36*c* takes place via fixation strut 50 on corner-part base 36 and fixation struts 52*a*, 52*b* on corner-part top 38*c*.

Figure 7:
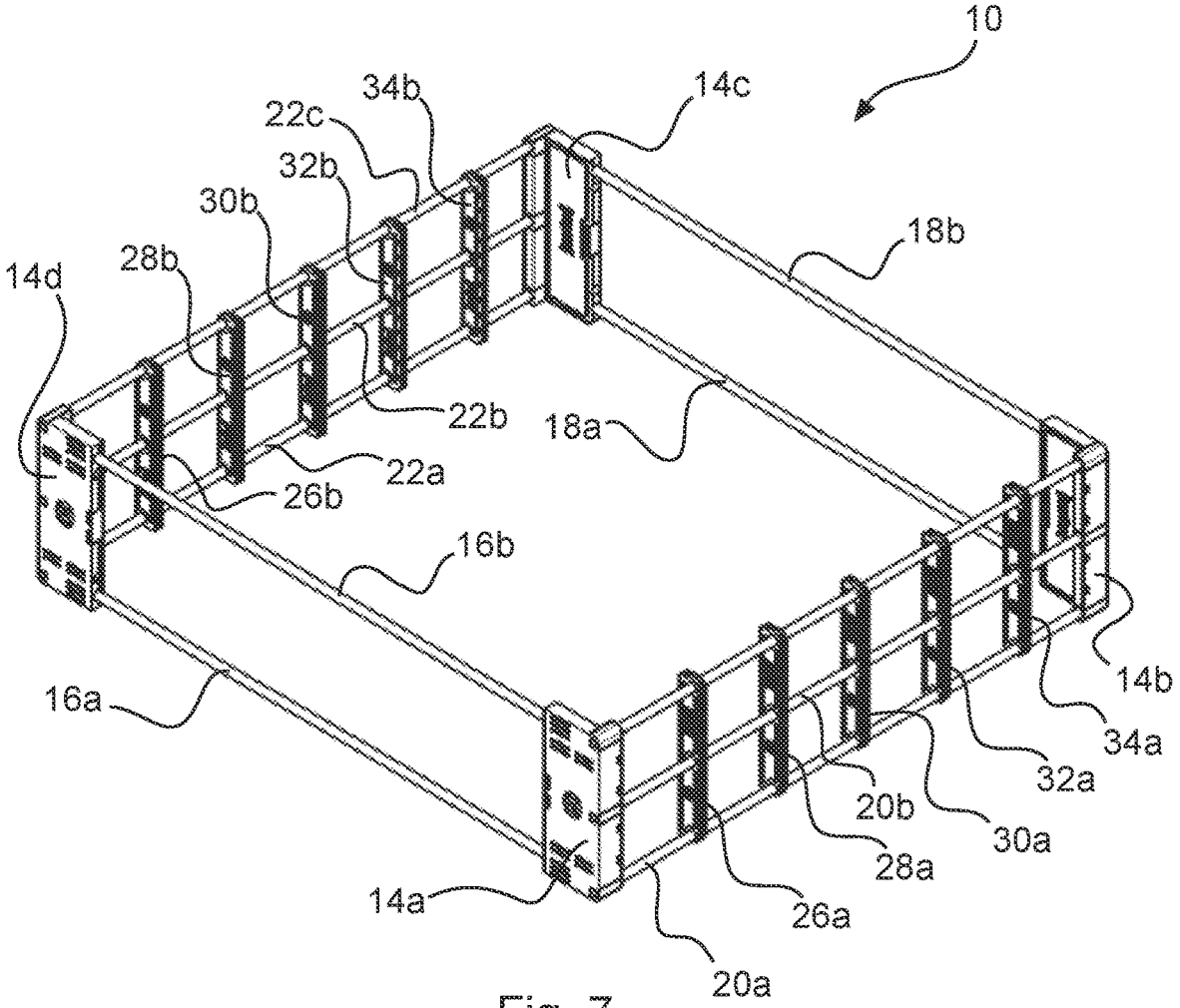
FIG. 7 shows an inventive drawer insert after completion of assembly in a perspective diagram.

FIG. 7 shows drawer insert 10 after completion of assembly.

Figure 8:
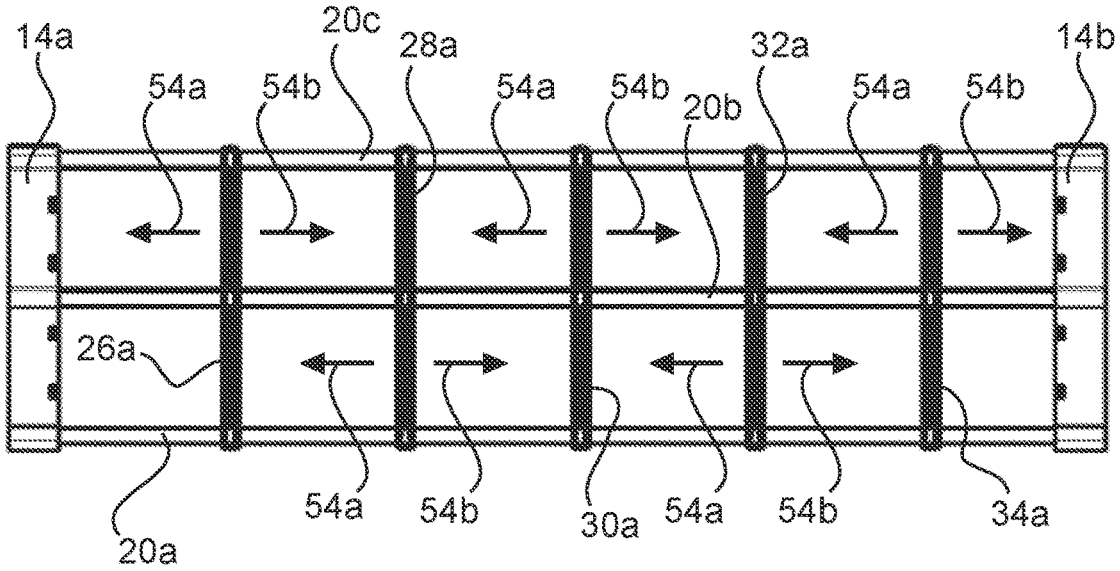
FIG. 8 shows an exemplary embodiment of the inventive drawer insert in a side view.

FIG. 8 shows that sliding elements 26*a*, 28*a*, 30*a*, 32*a*, 34*a* are freely displaceable along side parts 20*a*-20*c* in longitudinal direction of side parts 20*a*-20*c*. Sliding elements 26*a*, 28*a*, 30*a*, 32*a*, 34*a* as well as elastic dividing elements 24*a*-24*e* fastened on sliding elements 26*a*, 28*a*, 30*a*, 32*a*, 34*a* may be displaced either in direction 54*a* or in direction 54*b*. Due to the displaceability of sliding elements 26*a*, 28*a*, 30*a*, 32*a*, 34*a*, infinitely variable positionability of the end regions of dividing elements 24*a*-24*e* is made possible.

Figure 9:
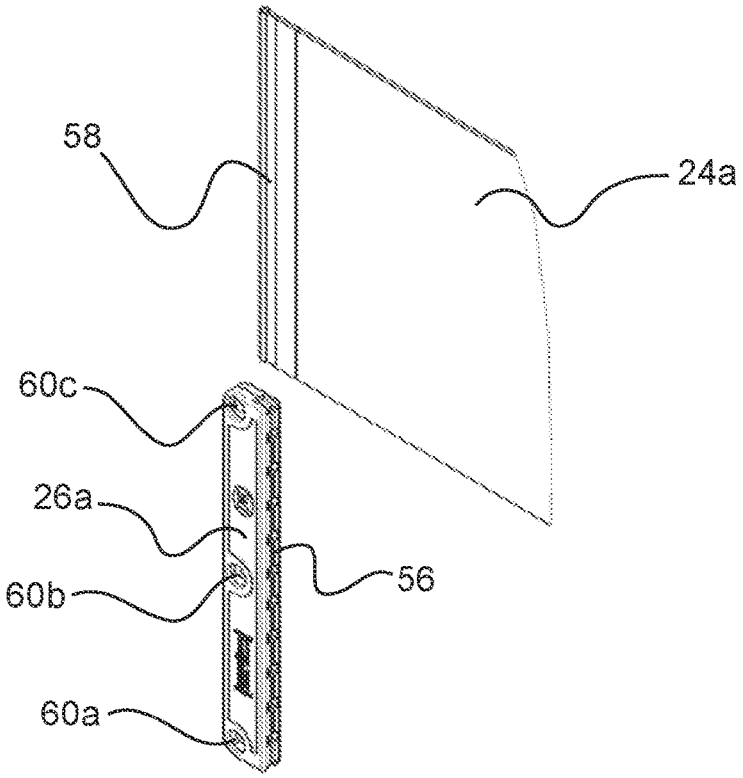
FIG. 9 shows an elastic dividing element of an inventive drawer insert during insertion into a sliding element in a perspective diagram.

FIG. 9 shows, by way of example, a sliding element 26*a* and an elastic dividing element 24*a* to be inserted into sliding element 26*a*. Sliding element 26*a* is made from plastic and comprises three slide recesses 60*a*-60*c* spaced apart from one another, wherein sliding element 26*a* is guided in longitudinal direction via slide recesses 60*a*-60*c* on side parts 20*a*-20*c* constructed as struts. Sliding element 26*a* has a push-in slot 56, into which an end portion 58 of elastic dividing element 24*a* can be pushed in nondestructively and reversibly detachable manner. This sliding element 26*a* is constructed as a keder rail, wherein end portion 58 of elastic dividing element 24*a* comprises a keder, which can be inserted into the keder rail. Elastic dividing element 24*a* may be constructed, for example, as an elastic tape or as an elastic strap.

Figure 10:
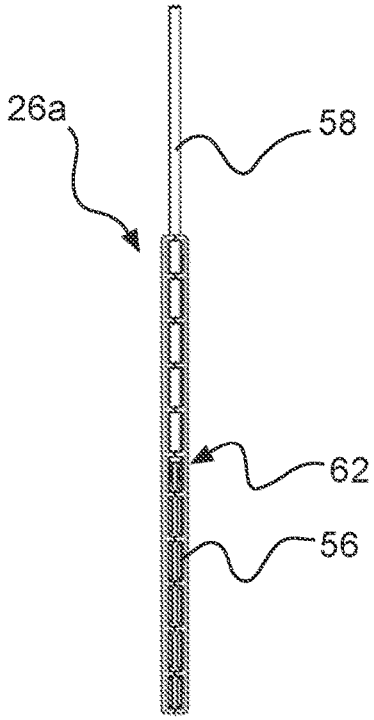
FIG. 10 shows an elastic dividing element of an inventive drawer insert during insertion into a sliding element in side view.
Figure 11:
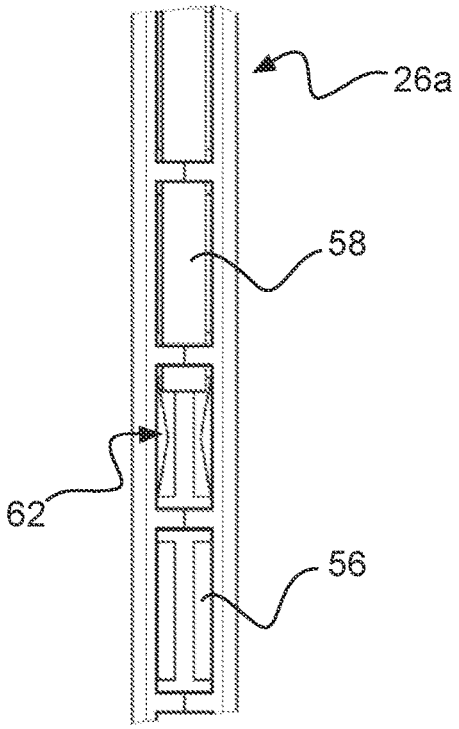
FIG. 11 shows a detail diagram of the elastic dividing element depicted in FIG. 10 during insertion into the sliding element.

FIGS. 10 and 11 show that a clamping device 62 is disposed inside push-in slot 56, wherein clamping device 62 has two oppositely disposed material projections. Clamping device 62 is set up to clamp end portion 58 of the pushed-in elastic dividing element. Hereby end portion 58 of the pushed-in elastic dividing element is stabilized in push-in slot 56 and the necessary pull-out force for withdrawal of the elastic dividing element is increased.

Figure 12:
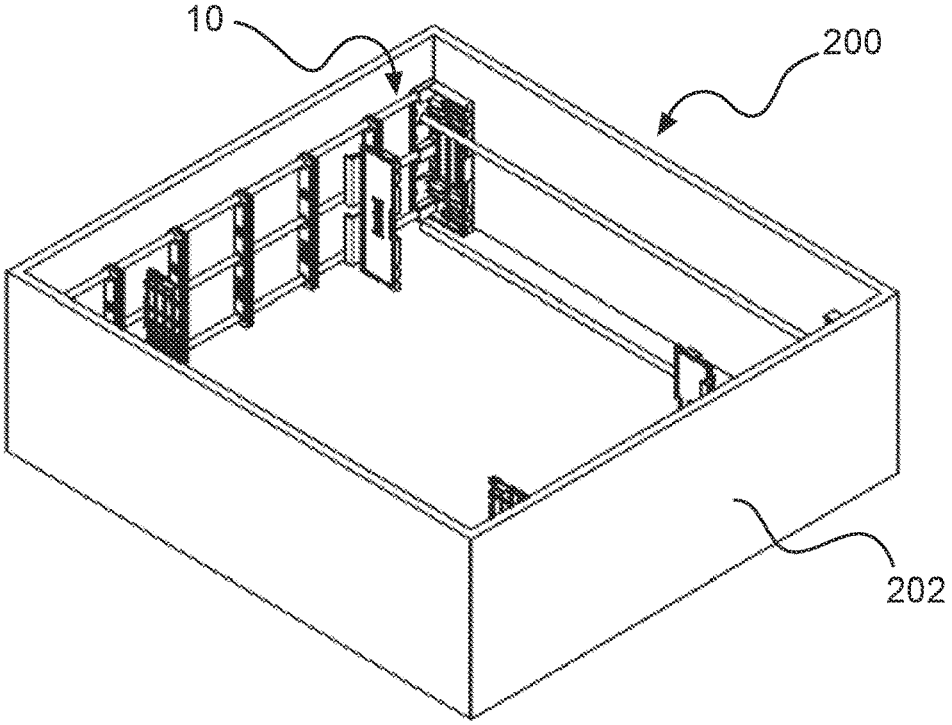
FIG. 12 shows an inventive drawer insert during assembly inside the drawer in a perspective diagram.
Figure 13:
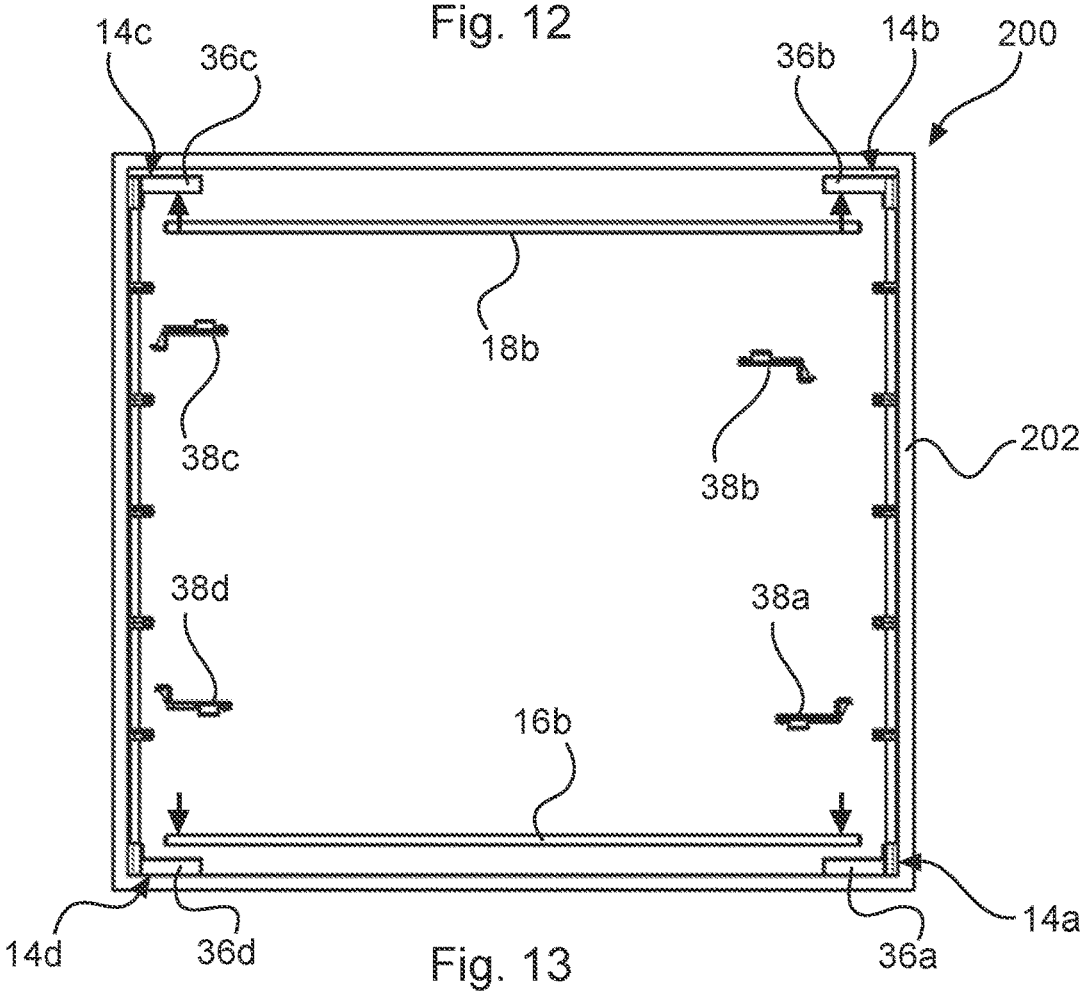
FIG. 13 shows a plan view of the drawer insert depicted in FIG. 12 during assembly inside the drawer.
Figure 14:
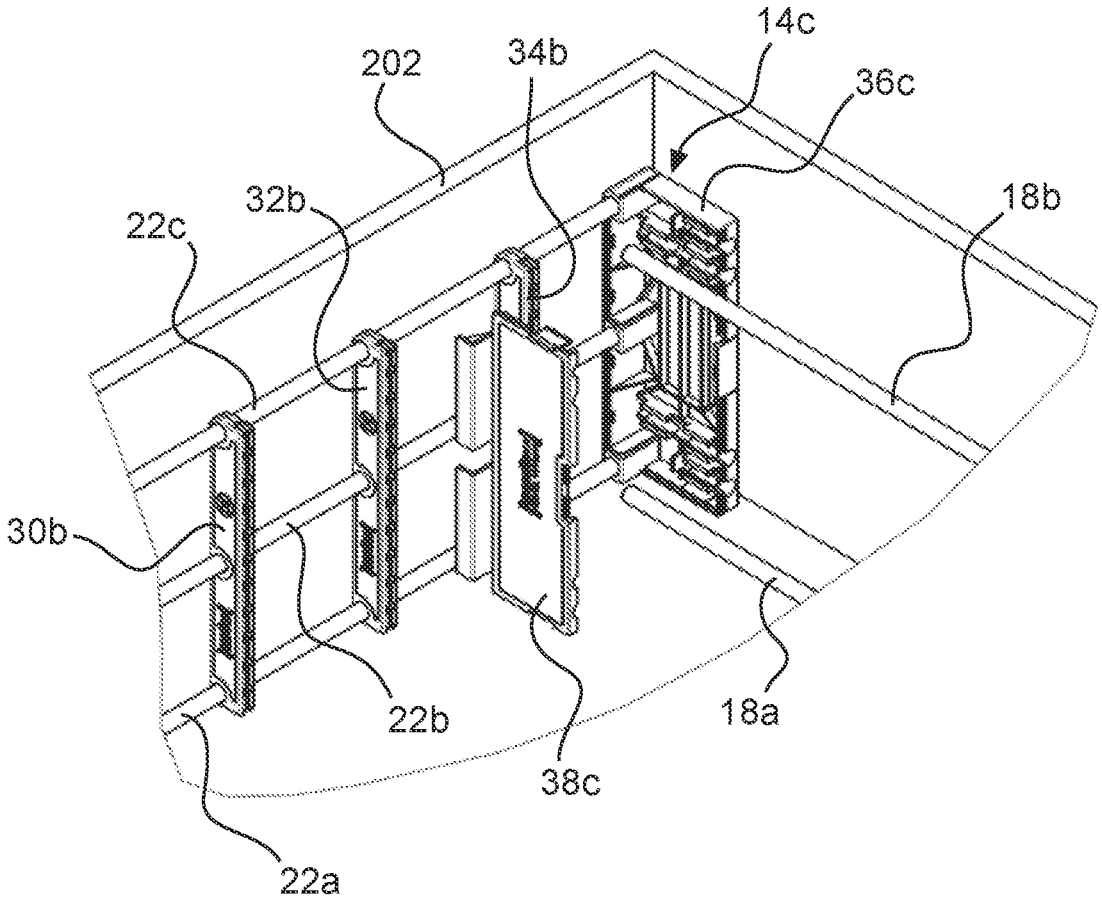
FIG. 14 shows a detail diagram of the drawer insert depicted in FIGS. 12 and 13 during assembly inside the drawer.

FIGS. 12 to 14 show how a drawer insert 10 is assembled inside the drawer. The resulting drawer unit 200 comprises a drawer 202, in the seating area of which the assembly of drawer insert 10 takes place.

The dimensions of frame structure 12 define a necessary rack space, wherein corner parts 14*a*-14*d* and side parts 16*a*, 16*b*, 18*a*, 18*b*, 20*a*-20*c*, 22*a*-22*c* of frame structure 12 can be joined as the frame structure 12 within the rack space, without the need to use installation space outside the rack space during assembly. Thus drawer insert 10 can be designed to be assembled inside the drawer and taken apart inside the drawer. Thus drawer insert 10 may be used without problems even in drawers 202 that are capable of only partial extension. By virtue of the ability of drawer insert 10 to be assembled and disassembled inside the drawer, the usability of drawer insert 10 is not limited by the fact that the accessibility of a drawer 202 is restricted due to the partial extension.

REFERENCE SYMBOLS

10 Drawer insert
12 Frame structure
14*a*-14*d* Corner parts
16*a*, 16*b* Side parts
18*a*, 18*b* Side parts
20*a*-20*c* Side parts
22*a*-22*c* Side parts
24*a*-24*e* Dividing elements
26*a*, 26*b* Sliding elements
28*a*, 28*b* Sliding elements
30*a*, 30*b* Sliding elements
32*a*, 32*b* Sliding elements
34*a*, 34*b* Sliding elements
36*a*-36*d* Corner-part bases
38*a*-38*d* Corner-part tops
40*a*-40*d* Clamping regions
42*a*-42*d* Seating and withdrawal paths
44*a*-44*c* Seats
46*a*-46*c* Plug-in and extraction paths
48*c* Movement path
50 Fixation strut
52*a*, 52*b* Fixation struts
54*a*, 54*b* Displacement directions
56 Push-in slot
58 End portion
60*a*-60*c* Slide recesses
62 Clamping device
64*a*, 64*b* Longitudinal units
66*a*-66*d* Stop faces
68*a*, 68*b* Wings
100 Assembly kit
200 Drawer unit
202 Drawer

What is claimed is:

1. A drawer insert comprising:

a frame structure comprising a plurality of corner parts and a plurality of elongated side parts; and a plurality of elastic dividing elements and a plurality of sliding elements, each sliding element of the plurality of sliding elements is joined to a respective elastic dividing element of the plurality of elastic dividing elements, and each elastic dividing element of the plurality of elastic dividing elements is displaceable fastened to the elongated side parts of the frame structure by the respective sliding element of the plurality of sliding elements;

wherein each elastic dividing element of the plurality of elastic dividing elements is an elastic band or an elastic belt;

wherein each sliding element of the plurality of sliding elements has a respective sliding recess of a plurality of sliding recesses, each sliding recess of the plurality of sliding recesses and a respective side part of the plurality of side parts having substantially a same cross-section;

wherein the plurality of corner parts and the plurality of side parts of the frame structure are joined to one another in non-destructively and reversibly detachable manner.

2. The drawer insert according to claim 1, wherein the frame structure is constructed without a bottom.

3. The drawer insert according to claim 1, wherein the plurality of corner parts and the plurality of side parts of the frame structure are joined to one another without tools in a manner detachable from one another.

4. The drawer insert according to claim 3, wherein the outside dimensions of the frame structure define a necessary rack space, wherein the plurality of corner parts and the plurality of side parts of the frame structure can be joined as the frame structure within the rack space.

5. The drawer insert according to claim 4, wherein at least one corner part respectively have one or more clamping regions, in which respectively a respective side part of the plurality of side parts can be clamped or clipped.

6. The drawer insert according to claim 5, wherein the one or more clamping regions respectively defines or define a seating and withdrawal path for the respective side part of the plurality of side part, wherein the seating and withdrawal path extends at right angles to the longitudinal axis of the respective side part of the plurality of side part.

7. The drawer insert according to claim 5, wherein at least one corner part has a corner-part base and a corner-part top, wherein the corner-part base comprises the at least one clamping region, which can be covered with the corner-part top after clamping or clipping of the respective side part of the plurality of side part.

8. The drawer insert according to claim 1, wherein at least one corner part respectively has one or more seats, into which respectively one side part can be pushed.

9. The drawer insert according to claim 8, wherein the one or more seats respectively defines or define a plug-in and extraction path for a side part, wherein the plug-in and extraction path extends parallel to the longitudinal axis of the plugged-in side part.

10. The drawer insert according to claim 1, wherein the respective sliding elements are displaceable along a side part in longitudinal direction of the side part.

11. The drawer insert according to claim 10, wherein the dividing elements are designed to be separable non-destructively from the frame structure without disassembly of the frame structure and to be joinable non-destructively with the frame structure.

12. The drawer insert according to claim 10, wherein the sliding elements respectively have a push-in slot, into which an end portion of the elastic dividing element can be non-destructively pushed in and reversibly withdrawn.

13. The drawer insert according to claim 1, wherein the dividing elements are transparent at least in portions.

14. An assembly kit for a drawer insert that can be mounted without tools, the assembly kit comprising:

the drawer insert, drawer insert comprising:

a frame structure comprising a plurality of corner parts and a plurality of elongated side parts; and a plurality of elastic dividing elements and a plurality of sliding elements, each sliding element of the plurality of sliding elements is joined to a respective elastic dividing element of the plurality of elastic dividing elements, and each elastic dividing element of the plurality of elastic dividing elements is displaceable fastened to the elongated side parts of the frame structure by the respective sliding element of the plurality of sliding elements;

wherein each elastic dividing element of the plurality of elastic dividing elements is an elastic band or an elastic belt;

wherein each sliding element of the plurality of sliding elements has a respective sliding recess of a plurality of sliding recesses, each sliding recess the plurality of sliding recesses and a respective side part of the plurality of side parts having substantially a same cross-section;

wherein the plurality of corner parts and the plurality of side parts of the frame structure are joined to one another in non-destructively and reversibly detachable manner.

15. A drawer unit comprising:

a drawer; and a drawer insert, which is disposed in the drawer;

wherein the drawer insert comprises:

a frame structure comprising a plurality of corner parts and a plurality of elongated side parts; and a plurality of elastic dividing elements and a plurality of sliding elements, each sliding element of the plurality of sliding elements is joined to a respective elastic dividing element of the plurality of elastic dividing elements, and each elastic dividing element of the plurality of elastic dividing elements is displaceable fastened to the elongated side parts of the frame structure by the respective sliding element of the plurality of sliding elements;

wherein each elastic dividing element of the plurality of elastic dividing elements is an elastic band or an elastic belt;

wherein each sliding element of the plurality of sliding elements has a respective sliding recess of a plurality of sliding recesses, each sliding recess of the plurality of sliding recesses and a respective side part of the plurality of side parts having substantially a same cross-section;

wherein the plurality of corner parts and the plurality of side parts of the frame structure are joined to one another in non-destructively and reversibly detachable manner.

* * * * *